US007938384B2

(12) United States Patent
Stevens et al.

(10) Patent No.: US 7,938,384 B2
(45) Date of Patent: May 10, 2011

(54) EXTENDED LENGTH STRAND TAKE UP DEVICE

(76) Inventors: James A. Stevens, Charlotte, NC (US); D. Scott Brooks, Saint Louis, MO (US); Richard L. Dillon, Lenexa, KS (US); Marcellus A. Chase, Saint Louis, MO (US)

( * ) Notice: Subject to any disclaimer, the term of this patent is extended or adjusted under 35 U.S.C. 154(b) by 76 days.

(21) Appl. No.: 12/168,890

(22) Filed: Jul. 8, 2008

(65) Prior Publication Data

US 2010/0008734 A1 Jan. 14, 2010

(51) Int. Cl.
*B21F 9/00* (2006.01)

(52) U.S. Cl. ..... 254/233; 254/231; 254/232; 254/234; 248/545; 403/79; 52/148; 174/40 TD

(58) Field of Classification Search ..... 254/231, 254/232, 233, 234; 248/499, 545; 403/79, 403/24, 2; 52/98, 148; 174/40 TD
See application file for complete search history.

(56) References Cited

U.S. PATENT DOCUMENTS

| | | | | | |
|---|---|---|---|---|---|
| 161,832 | A * | 4/1875 | Spencer | 403/43 |
| 299,795 | A * | 6/1884 | Jones et al. | 254/232 |
| 305,876 | A * | 9/1884 | Ainsworth | 254/233 |
| 938,488 | A * | 11/1909 | Hopkins | 254/231 |
| 957,823 | A * | 5/1910 | Viles | 403/46 |
| 974,637 | A * | 11/1910 | Borup | 254/233 |
| 1,020,748 | A * | 3/1912 | Dobson | 73/862.42 |
| 1,316,294 | A * | 9/1919 | Freed | 254/232 |
| 1,714,187 | A * | 5/1929 | Pacy | 29/897.1 |
| 2,654,796 | A * | 10/1953 | Hubbard | 254/232 |
| 3,346,236 | A * | 10/1967 | Hubbard et al. | 254/232 |
| 4,190,234 | A * | 2/1980 | Coleman | 254/232 |
| 4,760,640 | A * | 8/1988 | Lawrence | 29/760 |
| 5,911,409 | A * | 6/1999 | Grover | 254/235 |
| 7,097,154 | B2 * | 8/2006 | Stevens | 254/233 |
| 7,451,962 | B1 * | 11/2008 | Kennedy | 254/233 |

* cited by examiner

*Primary Examiner* — Emmanuel M Marcelo
(74) *Attorney, Agent, or Firm* — Marcellus A Chase

(57) ABSTRACT

An extended length strand take up device is presented that may be used to repair damaged guy wires in the field. The invention comprises two connecting bodies connected by a single tension rod that extends continuously between the two connecting bodies. Each connecting body slides over opposite ends of the tension rod and is held in place by a stop member, such as threaded nuts screwed onto the respective ends of the tension rod. The connecting bodies may further include an inwardly-facing pull tab or tabs that can be used for pre-tensioning the guy wire. An alternative embodiment of the invention comprises a single tension rod that is fixedly anchored to the ground and several connecting bodies that are fixedly mounted along the end of the guy wire at standard increments. The tension rod runs parallel to and overlaps the end of the guy wire. The connecting bodies slide along the length of the tension rod until the required tension and length is reached. A stop member, such as a threaded nut, is screwed onto the end of the tension rod holding the connecting bodies in place.

17 Claims, 1 Drawing Sheet

FIGURE
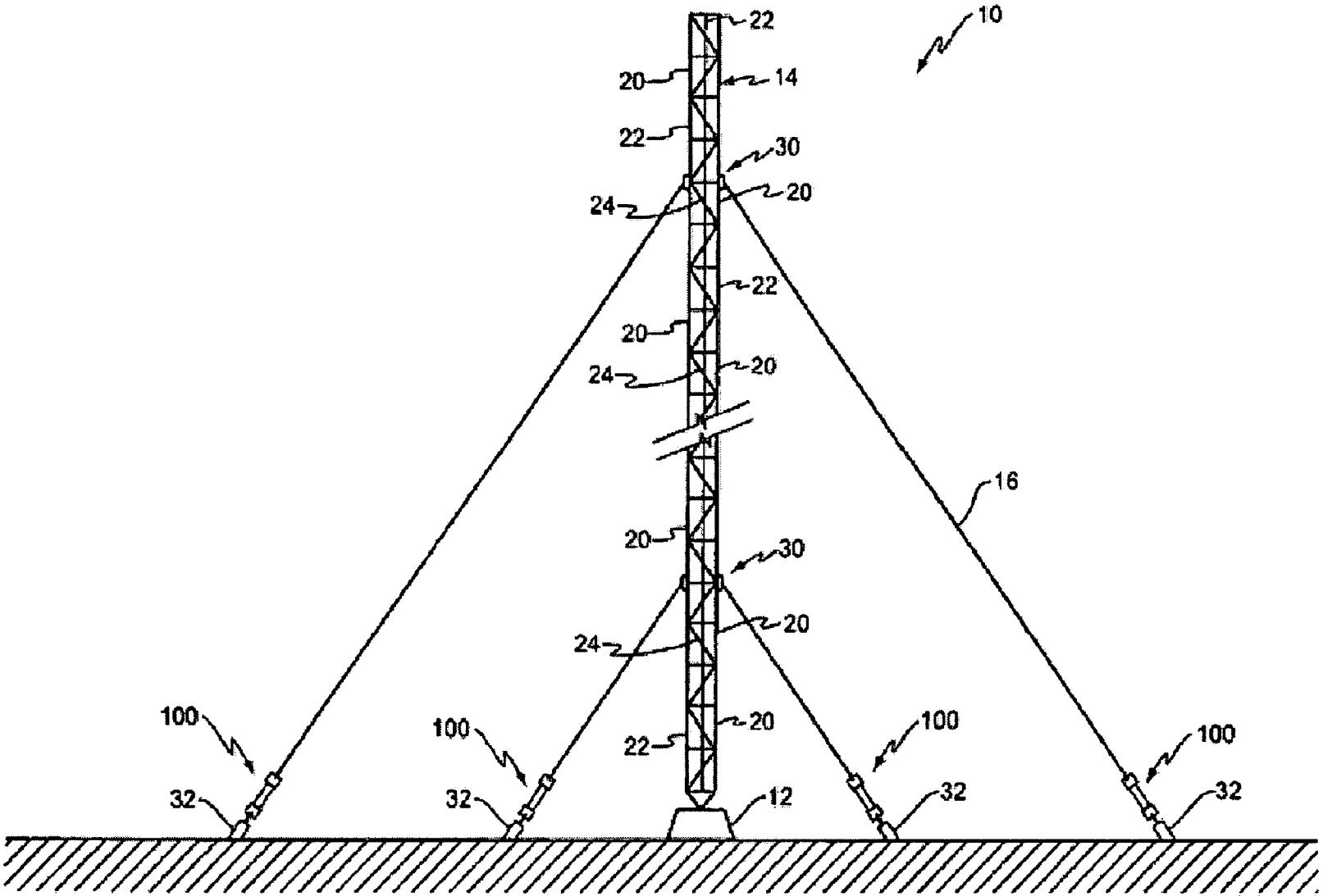

EXTENDED LENGTH STRAND TAKE UP DEVICE

FIELD OF THE INVENTION

The invention relates generally to guyed towers for broadcast radio, television, microwave and cellular communications and, more particularly, to a tensioning device for tensioning guy wires that stabilize guyed towers.

BACKGROUND OF THE INVENTION

There are three basic types of towers—guyed, self-supporting, and monopoles (MP). A guyed tower is a slender, steel structure supported by high strength steel guy cables that anchor the tower to the ground. A guyed tower is typically constructed in prefabricated sections that can be assembled and bolted together on site to reduce installation time and cost. Guyed towers suit a wide range of loading conditions and can be used as broadcast towers, microwave towers, and/or cellular towers.

Periodic inspections and maintenance of guyed towers is important to increase the service life of the tower and to ensure safety of persons and property in the vicinity of the tower. Severe loading conditions and corrosive forces can impair the integrity of the tower structure, and, if not corrected, can lead to tower failure. One area of concern is the presence of broken strands, corrosion, or fraying in guy wires. If damaged guy wires are not properly attended to, the guy wires may break under severe loading conditions, greatly increasing the possibility of a catastrophic failure.

It is recommended that guy wires and guy anchors be inspected at least quarterly. During such inspections, the ends of the guy wire are typically inspected for signs of fatigue, such as broken strands, or corrosion. Most guy wire failures occur at the ends of the guy wire adjacent the connection to either the tower or the ground anchor. If the guy wire shows signs of fatigue or excessive corrosion, the damaged end is cut off. A problem that often occurs when repairing damaged guy wires is that the remaining portion of the guy wire left after the damaged end is cut off is too short to make the connection between the tower and the ground anchor. In these cases, the entire guy wire is typically replaced, which can be time consuming and expensive. It would be beneficial if a way could be devised for reusing a guy wire that has been cut short to remove a damaged or frayed end.

SUMMARY OF THE INVENTION

The present invention relates to an extended length strand take up device that may be used to repair damaged guy wires in the field. One embodiment of the present invention comprises two connecting bodies connected by a tension rod that extends continuously between the connecting bodies. The tension rod may, for example and not by way of limitation, comprise a high-strength threaded rod. Each connecting body slides over opposite ends of the tension rod and is held in place by threaded nuts screwed onto the respective ends of the tension rod. The connecting bodies may further include an inwardly-facing pull tab that can be used for pre-tensioning the guy wire. A hydraulic tensioner may be connected between the pull tabs and used to tension the guy wire.

An alternative embodiment of the present invention comprises a tension rod that is fixedly anchored to the ground and several connecting bodies that are fixedly mounted along the end of the guy wire at standard increments. The tension rod runs parallel to and overlaps the end of the guy wire. The connecting bodies slide along the length of the tension rod until the required tension and length is reached. A threaded nut is screwed onto the end of the tension rod holding the connecting bodies in place.

BRIEF DESCRIPTION OF THE DRAWING

The FIGURE is a schematic illustration of a typical guyed tower.

DETAILED DESCRIPTION OF THE INVENTION

The FIGURE illustrates an exemplary guyed tower 10 according to one embodiment of the present invention. The guyed tower 10 comprises a concrete support base 12, a tower 14 extending vertically from the concrete support base 12, and guy wires 16 that anchor the tower 14 to the ground. The support base 12 and tower 14 may be of any conventional construction. In one embodiment, the tower 14 is constructed in tower sections 20 of predetermined length (e.g., twenty feet) that can be stacked and bolted together on site. Each section 20 may comprise three or four legs 22 interconnected by cross braces 24. The support legs 22 include connecting flanges (not shown) on the top and bottom ends thereof with openings therein to accept bolts for securing the tower sections 20 together. The support legs 22 may be formed of steel angle or steel tube or solid rods. The cross braces 24 may be formed of solid steel rods. The cross braces 24 may be welded or bolted to the support legs 22.

One or more sections 20 of the tower 14 include guy pull offs 30 that typically are welded or integrally formed with the support legs 22 at a predetermined height above the ground. The guy wires 16 extend from the guy pull off 30 to a ground anchor 32. The ground anchor 32 may, for example, comprise a screw-type anchor. An extended length strand take up device 100 is disposed along the length of the guy wire 16 to apply the appropriate tension to the guy wire 16. In conventional tower systems, a double-eye turnbuckle is used to tension the guy wire 16. However, a conventional turnbuckle has limited variability in length. In accordance with the present invention, an extended length strand take up device 100 is used in place of a conventional turnbuckle.

In a first embodiment, the extended length strand take up device 100 comprises a single tension rod, a pair of connecting bodies and a stop member at each end of the tension rod to keep the connecting bodies on the tension rod. A first of the two connecting bodies connects the tension rod to the guy wire 16. This first connecting body connects to the guy wire 16 by any known means of connecting a connecting body to a tension rod. Several means of connecting a connecting body to a tension rod are readily available in the prior art, therefore, no further description will be provided. The second of the two connecting bodies connects the tension rod to a ground anchor 32. This second connecting body connects to the ground anchor by any known means of connecting a ground anchor 32 to a tension rod. Several means of connecting a ground anchor 32 to a tension rod are readily available in the prior art, therefore, no further description will be provided. Each of the first and second connecting body is sized to slide over the tension rod.

The tension rod extends continuously between the connecting bodies without any break. The tension rod is optionally threaded over a length at one end, but may be preferably threaded along the entire length. A nut threads onto the threaded end of the tension rod to retain the connecting body on the tension rod. If the entire length of the tension rod is threaded, two nuts are threaded onto the tension rod, one at each end. Each nut retains one of the connecting bodies on the tension rod. A bearing plate and washer may be optionally disposed between the end of any one or more of the connecting bodies and nut. The nuts serve as stop members to retain the connecting bodies on the tension rod. Other types of stop members may also be used. For example, and not by way of limitation, at least one end of the tension rod may be enlarged to form an integral stop member. Alternatively, at least one end of the tension rod could be flared to serve as a stop member.

At least one of the connecting bodies may optionally be an ordinary turnbuckle, wherein one end of the turnbuckle is screwed onto a threaded end of the tension rod. At least one of the connecting bodies optionally includes an opening to facilitate connection with a connection member, such as a spelter socket or screw anchor. Optionally, the tension rod includes a plurality of notches along at least one end, wherein a stop member engages securely with the notches to retain the connecting body on the tension rod. A cross section of the tension rod is optionally a polygon or oval. A connecting body may also optionally include a pull tab, with a tab opening formed therein, the pull tab extending toward the other connecting body. As will be described below, a hydraulic tensioner may be interconnected between two pull tabs to tension the guy wire 16 during installation.

The extended length strand take up device may be installed in the field by a repairman as follows. A first connecting body is secured to the free end of the guy wire 16 by a spelter socket or other connection member. The second connecting body is secured to the ground anchor 32. A tension rod of a desired length is inserted through the connecting bodies. The tension rod passes through each connecting body, with one on each end of the tension rod, to form an unbroken connection between the two connecting bodies. The connecting bodies are pulled toward one another to tension the guy wire 16 to approximately 10% of the breaking strength of the guy wire 16. To pull the connecting bodies together, a hydraulic tensioner (not shown) may be connected to the optional pull tabs on the connecting bodies. After the guy wire is tensioned to the desired amount, the bearing plate, washer, and nuts are installed on the threaded ends of the tension rod to retain the connecting bodies on the tension rod. The nuts should be tightened while the hydraulic tensioner is still in place. After tightening the nuts, the hydraulic tensioner can be removed. When the hydraulic tensioner is removed, the tension rod is placed in tension and serves to transfer loads between the connecting bodies.

A second embodiment of the extended length strand take up device 100 is similar to that of the first embodiment. In the second embodiment, however, the connecting body for connecting with the ground anchor 32 includes a link member that extends from the connecting body. For example, and not by way of limitation, the link member is made of a flat steel bar that is welded to or integrally formed with the connecting body. In this embodiment, the optional opening of the connecting body is replaced by a transverse opening in the link member, so that the transverse opening in one connecting body and the optional opening in the other connecting body are disposed at ninety degrees with respect to one another. This arrangement of the openings is useful for certain types of ground anchors.

In a third embodiment of the extended length strand take up device 100, a tension rod is fixedly mounted to a ground anchor. The tension rod is mounted to the ground anchor by any known means. The tension rod runs parallel to and overlaps an end of a guy wire. The end of the guy wire includes a plurality of connecting bodies fixedly mounted along it at desired intervals. The connecting bodies are mounted to the guy wire by any known means. The plurality of connecting bodies are sized to slide onto and up and down the tension rod. At least one stop member is secured at the end of the tension rod to retain the connecting bodies on the tension rod. The tension rod transfers loads between the connecting bodies and the ground anchor when the extended length strand take up device is placed in tension.

The tension rod extends continuously from the ground anchor through the connecting bodies without any break. The tension rod is optionally threaded over a length at the distal end, with respect to the ground anchor, but may preferably be threaded along the entire length. Optionally, a nut threads onto the threaded end of the tension rod to retain the connecting bodies on the tension rod. Alternatively, a plurality of nuts are threaded onto the tension rod, for examples one per each connecting body, although not every connecting body requires a nut so long as at least one connecting body is retained on the tension rod with a stop member. Each nut retains one of the connecting bodies on the tension rod. A bearing plate and washer may be optionally disposed between the end of any one or more of the connecting bodies and nut. The nuts serve as stop members to retain the connecting bodies on the tension rod. Other types of stop members may also be used. For example, and not by way of limitation, the end of the tension rod may be enlarged to form an integral stop member. Alternatively, the end of the tension rod could be flared to serve as a stop member.

At least one of the connecting bodies, preferably each one, optionally includes an opening to facilitate connection with a connection member, such as a spelter socket or screw anchor. Optionally, the tension rod includes a plurality of notches along the distal end, wherein a stop member engages securely with the notches to retain the connecting bodies on the tension rod. A cross section of the tension rod is optionally a polygon or oval. At least one of the connecting bodies, preferably each one, may also optionally include a pull tab, with a tab opening formed therein, the pull tab extending toward the ground anchor. With a similar pull tab on the ground anchor that extends toward the connecting bodies, a hydraulic tensioner may be interconnected between two pull tabs to tension the guy wire 16 during installation, as described above.

An advantage of the present invention is that tension rods of any desired length can be used without compromising the structural integrity of the tensioner. If a guy wire 16 is cut short to remove a damaged portion thereof, longer tension rods may be used to make the connection between the guy wire end and the ground anchor 32. Thus, the extended length strand take up device of the present invention avoids the need to replace a guy wire 16 that has been cut short.

What is claimed is:

1. An extended length strand take up device, comprising:

a. a single tension rod;

b. a first connecting body mounted on the tension rod for connecting the extended length strand take up device to a guy wire;

c. a second connecting body mounted on the tension rod for connecting the extended length take up device to a ground anchor, wherein at least one of the first and second connecting bodies is slidably mounted on said tension rod for movement along said tension rod toward and away from the other connecting body; and d. a stop member at each end of the tension rod to retain the first and second connecting bodies on the tension rod, wherein said tension rod transfers loads between said first and second connection bodies when said extended length strand take up device is placed in tension;

wherein at least one of the first and second connecting bodies further include an opening to receive a connection member;

wherein the second connecting body further comprises a link member extending outwardly from said second connecting body toward said ground anchor; and wherein the opening in the at least one of the first and second connecting body is formed in the link member of the second connecting body.

2. The extended length strand take up device of claim 1 wherein the first connecting body further includes a first at least one pull tab projecting toward the second connecting body and the second connecting body further includes a second at least one pull tab projecting toward the first connecting body, wherein the first and second at least one pull tabs can be engaged with at least one hydraulic tensioner.

3. The extended length strand take up device of claim 1 wherein the tension rod has at least one threaded end and wherein the stop members comprise at least one nut that threads onto the at least one threaded end of the tension rod.

4. The extended length strand take up device of claim 1 wherein the tension rod extends through at least one of the first and second connecting bodies so that the tension rod transfers loads between the connecting bodies.

5. The extended length strand take up device of claim 1 wherein a cross section of the tension rod is a polygon or an oval.

6. The extended length strand take up device of claim 1 wherein the tension rod further includes a plurality of notches along at least one end, wherein at least one of said stop members engages securely with the notches.

7. The extended length strand take up device of claim 1 wherein at least one of the first and second connecting bodies is a turnbuckle.

8. An extended length strand take up device comprising:

a. a single tension rod, fixedly mounted to a ground anchor, wherein the tension rod overlaps and runs parallel to an end of a guy wire;

b. a plurality of connecting bodies, fixedly mounted along the end of the guy wire and slidably mounted on the tension rod; and c. at least one stop member at a distal end, with respect to the ground anchor, of the tension rod to retain the plurality of connecting bodies on the tension rod, wherein said tension rod transfers loads between said connection bodies and the ground anchor when said extended length strand take up device is placed in tension;

wherein a cross section of the tension rod is a polygon or an oval.

9. The extended length strand take up device of claim 8 wherein at least one of the plurality of connecting bodies further includes an opening to receive a connection member.

10. The extended length strand take up device of claim 8 wherein at least one of the plurality of connecting bodies further includes a first pull tab projecting toward the ground anchor and the ground anchor further includes a second pull tab projecting toward the at least one of the plurality of connecting bodies, wherein the first and second pull tabs can be engaged with a hydraulic tensioner.

11. The extended length strand take up device of claim 8 wherein the distal end of the tension rod is threaded and wherein the at least one stop member comprises a nut that threads onto the threaded end of the tension rod.

12. The extended length strand take up device of claim 8 wherein the area of a cross section of the tension rod is uniform throughout the length of the tension rod.

13. The extended length strand take up device of claim 8 wherein the tension rod further includes a plurality of notches along the distal end, wherein the at least one stop member engages securely with the notches.

14. An extended length strand take up device, comprising:

a. a tension rod;

b. a first connecting body mounted on the tension rod for connecting the extended length strand take up device to a guy wire;

c. a second connecting body mounted on the tension rod for connecting the extended length take up device to a ground anchor, wherein at least one of the first and second connecting bodies is slidably mounted on said tension rod for movement along said tension rod toward and away from the other connecting body; and d. a stop member at each end of the tension rod to retain the first and second connecting bodies on the tension rod, wherein said tension rod transfers loads between said first and second connection bodies when said extended length strand take up device is placed in tension;

wherein at least one of the first and second connecting bodies further include an opening to receive a connection member;

wherein the second connecting body further comprises a link member extending outwardly from said second connecting body toward said ground anchor; and wherein the opening in the at least one of the first and second connecting body is formed in the link member of the second connecting body.

15. An extended length strand take up device, comprising:

a. a tension rod;

b. a first connecting body mounted on the tension rod for connecting the extended length strand take up device to a guy wire;

c. a second connecting body mounted on the tension rod for connecting the extended length take up device to a ground anchor, wherein at least one of the first and second connecting bodies is slidably mounted on said tension rod for movement along said tension rod toward and away from the other connecting body; and d. a stop member at each end of the tension rod to retain the first and second connecting bodies on the tension rod, wherein said tension rod transfers loads between said first and second connection bodies when said extended length strand take up device is placed in tension;

wherein a cross section of the tension rod is a polygon or an oval.

16. An extended length strand take up device comprising:

a. a tension rod, fixedly mounted to a ground anchor, wherein the tension rod overlaps and runs parallel to an end of a guy wire;

b. a plurality of connecting bodies, fixedly mounted along the end of the guy wire and slidably mounted on the tension rod; and c. at least one stop member at a distal end, with respect to the ground anchor, of the tension rod to retain the plurality of connecting bodies on the tension rod, wherein said tension rod transfers loads between said connection bodies and the ground anchor when said extended length strand take up device is placed in tension;

wherein a cross section of the tension rod is a polygon or an oval.

17. An extended length strand take up device, comprising:

a. a single tension rod;

b. a first connecting body mounted on the tension rod for connecting the extended length strand take up device to a guy wire;

c. a second connecting body mounted on the tension rod for connecting the extended length take up device to a ground anchor, wherein at least one of the first and second connecting bodies is slidably mounted on said tension rod for movement along said tension rod toward and away from the other connecting body; and d. a stop member at each end of the tension rod to retain the first and second connecting bodies on the tension rod, wherein said tension rod transfers loads between said first and second connection bodies when said extended length strand take up device is placed in tension;

wherein a cross section of the tension rod is a polygon or an oval.

* * * * *